US010634090B2

(12) United States Patent
DiMascio et al.

(10) Patent No.: US 10,634,090 B2
(45) Date of Patent: Apr. 28, 2020

(54) PISTON FOR AN INTERNAL COMBUSTION ENGINE

(71) Applicant: INNIO Jenbacher GmbH & Co OG, Jenbach (AT)

(72) Inventors: Paul Stephen DiMascio, Greer, SC (US); Magdalena Gaca, Grudziadz (PL); Piotr Zajac, Warsaw (PL); Sebastian Niedziela, Wabrzych (PL); Luke Pearson, Rum (AT)

(73) Assignee: GE JENBACHER GmbH & CO OG, Jenbach (AT)

( * ) Notice: Subject to any disclaimer, the term of this patent is extended or adjusted under 35 U.S.C. 154(b) by 148 days.

(21) Appl. No.: 15/738,642

(22) PCT Filed: Jun. 30, 2016

(86) PCT No.: PCT/AT2016/050239

§ 371 (c)(1),
(2) Date: Apr. 11, 2018

(87) PCT Pub. No.: WO2017/004645

PCT Pub. Date: Jan. 12, 2017

(65) Prior Publication Data

US 2019/0093596 A1 Mar. 28, 2019

(30) Foreign Application Priority Data

Jul. 3, 2015 (AT) ..... A 429/2015

(51) Int. Cl.
*F02F 3/12* (2006.01)

(52) U.S. Cl.
CPC ..... *F02F 3/12* (2013.01); *F05C 2251/048* (2013.01)

(58) Field of Classification Search
CPC ..... F02F 3/12
See application file for complete search history.

(56) References Cited

U.S. PATENT DOCUMENTS

| | | | | |
|---|---|---|---|---|
| 3,189,010 | A | 6/1965 | Isley | |
| 3,976,809 | A * | 8/1976 | Dowell | B24C 11/00 427/454 |
| 4,471,017 | A | 9/1984 | Poeschel et al. | |
| 4,711,208 | A | 12/1987 | Sander et al. | |
| 6,803,135 | B2 | 10/2004 | Liu et al. | |
| 8,220,433 | B2 | 7/2012 | Sasaki | |

(Continued)

FOREIGN PATENT DOCUMENTS

| | | | |
|---|---|---|---|
| DE | 19524015 | A1 | 4/1996 |
| DE | 10242261 | A1 | 3/2004 |

(Continued)

OTHER PUBLICATIONS

Office Action issued in connection with corresponding AT Application No. A 429/2015 dated Jan. 27, 2016.

(Continued)

*Primary Examiner* — Thomas E Lazo
(74) *Attorney, Agent, or Firm* — Fletcher Yoder, P.C.

(57) ABSTRACT

A piston for an internal combustion engine with a piston crown and a circumferentially arranged crown edge, whereby, near the periphery of the crown edge, a thermal barrier coating is applied, whereby the thermal barrier coating tapers off before the periphery of the crown edge.

9 Claims, 2 Drawing Sheets

(56) References Cited

U.S. PATENT DOCUMENTS

| | | | |
|---|---|---|---|
| 8,272,843 | B1 | 9/2012 | Ryznic et al. |
| 8,430,020 | B2 | 4/2013 | Fujiwara et al. |
| 2003/0084858 | A1 | 5/2003 | Kracklauer |
| 2007/0113802 | A1 | 5/2007 | Mihara |
| 2008/0167403 | A1 | 7/2008 | Burkle |
| 2012/0180749 | A1 | 7/2012 | Kopchick et al. |
| 2012/0222646 | A1 | 9/2012 | Sasaki |
| 2013/0025561 | A1 | 1/2013 | Gabriel et al. |

FOREIGN PATENT DOCUMENTS

| | | | | | |
|---|---|---|---|---|---|
| EP | 0 075 228 | A2 | | 3/1983 | |
| EP | 0 136 741 | A1 | | 4/1985 | |
| EP | 2 549 089 | A1 | | 1/2013 | |
| EP | 2 096 290 | B1 | | 6/2014 | |
| JP | S60119348 | A | | 6/1985 | |
| JP | S6036551 | B2 | * | 8/1985 | ..... B01J 6/004 |
| JP | S60240856 | A | | 11/1985 | |
| JP | S6158915 | A | | 3/1986 | |
| JP | S6261770 | A | | 3/1987 | |
| JP | 2010071134 | A | | 4/2010 | |
| JP | 2013087721 | A | | 5/2013 | |
| JP | 2014020300 | A | * | 2/2014 | |
| JP | 2014105619 | A | | 6/2014 | |
| KR | 10-2014-0004311 | A | | 1/2014 | |
| WO | 01/96726 | A1 | | 12/2001 | |
| WO | 2015/076317 | A1 | | 5/2015 | |

OTHER PUBLICATIONS

PCT International Search Report and Written Opinion; Application No. PCTAT2016/050239; dated Sep. 29, 2016; 4 pages.

* cited by examiner

PISTON FOR AN INTERNAL COMBUSTION ENGINE

TECHNOLOGY FIELD

The invention relates to a piston for an internal combustion engine, and an internal combustion engine.

BACKGROUND

From the operation of pistons, it is known that carbon deposits on a piston bottom or piston crown can impair the function of the piston and degrade the efficiency and emissions of the associated internal combustion engine. From US 2008/0167403 A1, a measure is known against the buildup of carbon deposits consisting of applying a non-stick layer to a piston or piston ring of an internal combustion engine. It is known from US 2013/0025561 A1 that the depression of a depression piston can be provided with a thermal barrier coating (TBC) in order to increase the resistance of the piston against thermo-mechanical fatigue.

BRIEF DESCRIPTION

The object of an embodiment is to reduce carbon deposits.

By applying a thermal barrier coating near the periphery of the crown edge, the temperatures in the region of the uppermost fire land and the first (uppermost) annular groove are reduced, whereby the formation of carbon deposits is reduced significantly and the stresses in the region of the uppermost piston ring are reduced. It is provided that the cover layer is arranged on the adhesion promoter layer and the adhesion promoter layer is arranged on the crown edge. It has been shown to be particularly favorable to construct the thermal barrier coating in two layers. The adhesion promoter layer is more particularly matched in terms of its thermal expansion coefficient between the substrate, i.e. the piston, and the cover layer, so as to minimize the thermal stresses.

It is more particularly provided that the thermal barrier coating extends on the piston crown near the crown edge in the direction of a center of the piston crown.

The thermal barrier coating thus more particularly forms a circumferential ring on the piston crown, which extends in the direction of the center of the piston.

It is more particularly provided that the thermal barrier coating extends on the piston crown near the crown edge in the direction of a radial position spaced from the center of the piston crown, more particularly to a radial position of about 80% of the distance between the crown edge and the center of the piston crown, measured from the center of the piston crown. In other words, the thermal barrier coating more particularly covers a seam of the piston crown with a width of about 20% based on the radial dimension of the thermal barrier coating in the direction of the center of the piston crown.

It can be provided that the thermal barrier coating has a decreasing thickness in the direction of the center of the piston crown. Due to this gradual progression of the thermal barrier coating, a particularly favorable adhesion to the substrate is created and thermal stresses are reduced.

It can be provided that a fire land area or a piston skirt of the piston is free of the thermal barrier coating.

It is usually provided that a plurality of grooves is arranged in a fire land area of the piston near the piston crown.

It is more particularly provided that the cover layer of the thermal barrier coating consists of a ceramic, more particularly yttrium-stabilized zirconia, and more particularly has a dense vertically cracked structure. In the applicant's experiments, yttrium-stabilized zirconia (YSZ), which is more particularly applied via plasma spray, was found to be particularly advantageous as a thermal barrier coating. The thermal barrier coating more particularly has a so-called DVC ("dense vertically cracked") structure. Thermal barrier coatings with a DVC structure are superior to conventional layered structures in terms of thermal cycling.

It can be provided that the adhesion promoter layer of the thermal barrier coating consists of a metal alloy.

Protection is also sought for an internal combustion engine, more particularly a stationary internal combustion engine.

Particular advantages of the invention are: Improved durability, robustness and reliability of the internal combustion engine, Reduced fuel consumption, Reduced oil consumption, Increased oil and oil filter life, Increased life of the uppermost piston ring, Reduced risk of unexpected cylinder exchange, Expanded possibilities for emissions and efficiency optimization.

Also, it has been found that, if necessary, the use of a scraper ring can be dispensed with by using an embodiment of the invention.

An embodiment of the invention allows the use of narrower fire lands, which is advantageous in terms of hydrocarbon emissions.

The temperatures below the piston crown are reduced, which increases the oil life.

An embodiment of the invention differs quite fundamentally from measures against carbon deposits known in the prior art. Instead of reducing carbon deposits by anti-adhesion layers on the surface, an embodiment of the invention reduces the temperature in the region of the upper fire land and the upper annular groove and thus prevents the formation of any carbon deposits

BRIEF DESCRIPTION OF THE DRAWINGS

The invention is explained in more detail by the figures below. They are as follows.

DETAILED DESCRIPTION

Figure 1:
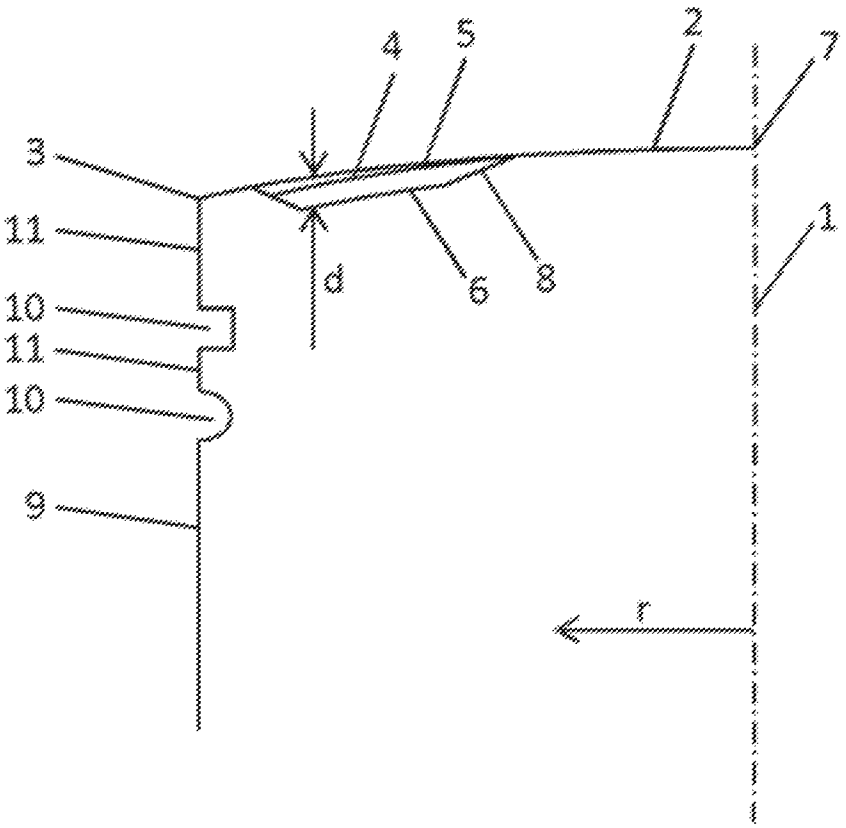
FIG. 1 schematic representation of a piston in an overview.

FIG. 1 shows a schematic representation of a piston 1 in cross-section for orientation and naming of the components. The piston 1 has a piston crown 2 and a crown edge 3. At the part adjacent to the crown edge 3 of the lateral surface of the piston 1, the piston skirt 9, fire lands 11 are formed. These are the areas between which the annular grooves 10 for receiving piston rings are located. A thermal barrier coating 4 extends, starting near the outer periphery of the piston 1, i.e. near the crown edge 3 in the direction of the center 7 of the piston 1. In the exemplary embodiment shown, the thermal barrier coating 4 has an adhesion promoter layer 6 and a cover layer 5. The thickness of the thermal barrier coating 4 is indicated by the reference sign d. The thermal barrier coating 4 extends as a circumferential ring or seam on the piston crown 2 to near an edge 8. More particularly, the thickness d of the thermal barrier coating 4 decreases in a region of the edge 8, resulting in a favorable gradual transition to the uncoated region of the piston crown 2. The radial distance r from the center 7 of the piston 1 is introduced to describe a radial extent of the thermal barrier coating 4.

Figure 2:
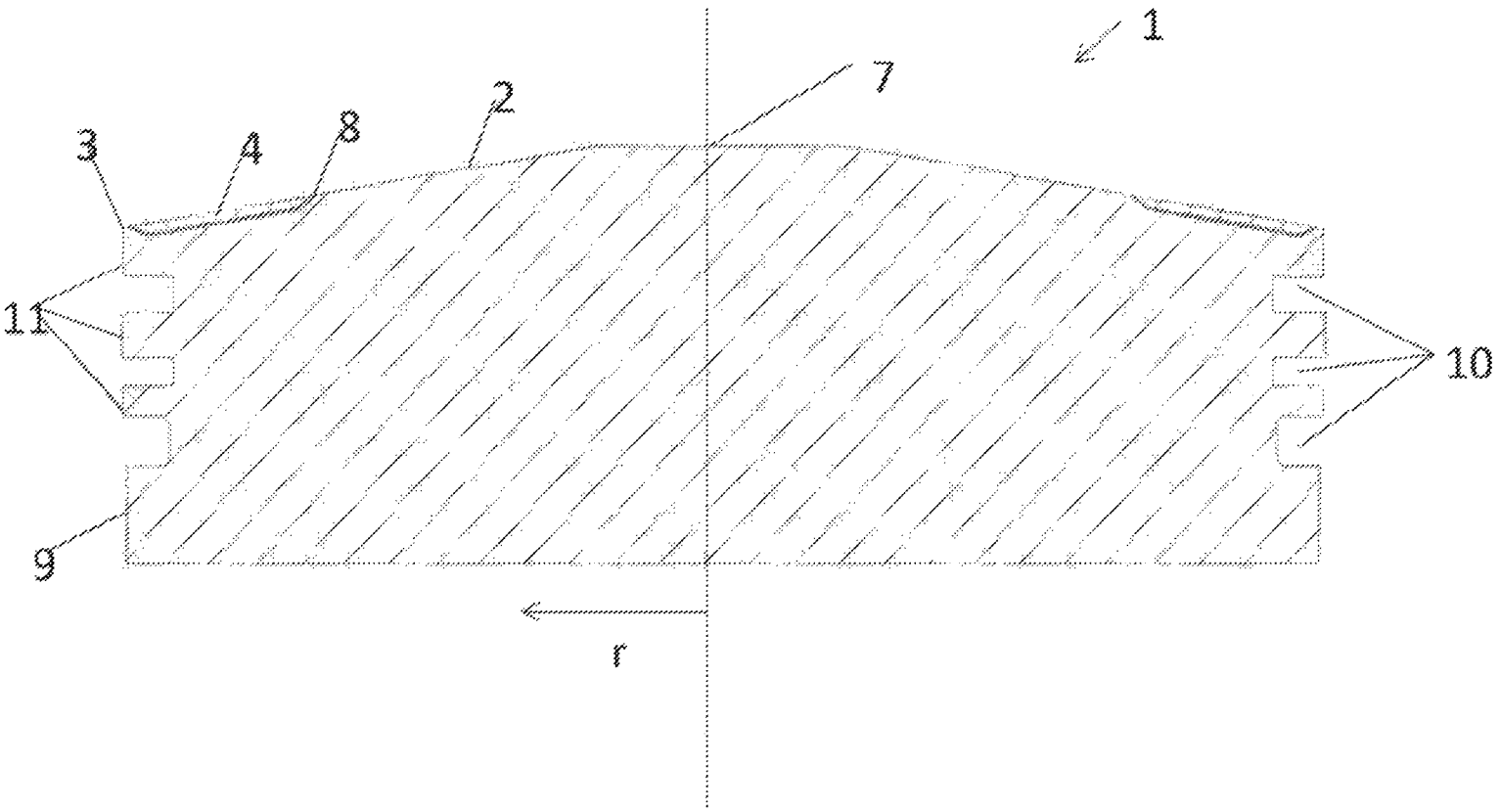
FIG. 2 thermal barrier coating in one exemplary embodiment

FIG. 2 shows a piston 1 with a thermal barrier coating 4 in an exemplary embodiment according to the invention.

The thermal barrier coating 4 is not pulled to the crown edge 3, but runs directly in front of it. The layer therefore only goes near to the crown edge 3.

The invention claimed is:

1. A piston for an internal combustion engine with a piston crown and a circumferentially arranged crown edge, wherein, near the periphery of the crown edge, a thermal barrier coating is applied, wherein the thermal barrier coating tapers off before the periphery of the crown edge, wherein the thermal barrier coating extends in a radial direction relative to a center of the piston crown from the center of the piston crown toward the crown edge, and wherein the thermal barrier coating extending in the radial direction on the piston crown near the crown edge is located at a radial position (r) spaced from the center of the piston crown that begins, away from the center of the piston crown, 80% of a distance between the crown edge and the center of the piston crown.

2. The piston according to claim 1, wherein the thermal barrier coating comprises a cover layer and an adhesion promoter layer, wherein the cover layer is arranged on the adhesion promoter layer and the adhesion promoter layer is arranged on the crown edge.

3. The piston according to claim 2, wherein the cover layer of the thermal barrier coating comprises ceramic.

4. The piston according to claim 2, wherein the adhesion promoter layer of the thermal barrier coating consists of a metal alloy.

5. The piston according to claim 1, wherein the thermal barrier coating has a decreasing thickness (d) in the direction of the center of the piston crown.

6. The piston according to claim 5, wherein a fire land area of the piston is free of the thermal barrier coating.

7. The piston according to claim 6, wherein in a fire land area of the piston near the piston crown, a plurality of grooves are arranged.

8. An internal combustion engine, comprising at least one piston according to claim 1.

9. The piston according to claim 1, wherein the thermal barrier coating is annular shaped and has an inner perimeter and an outer perimeter, and the thermal barrier coating tapers both in the radial direction towards the inner perimeter and in the radial direction towards the outer perimeter.

* * * * *